US012150488B2

(12) United States Patent
Leadley

(10) Patent No.: US 12,150,488 B2
(45) Date of Patent: Nov. 26, 2024

(54) TEMPERATURE REGULATING SYSTEM FOR AN ELECTRONIC VAPOR PROVISION SYSTEM

(71) Applicant: Nicoventures Trading Limited, London (GB)

(72) Inventor: David Leadley, London (GB)

(73) Assignee: NICOVENTURES TRADING LIMITED, London (GB)

( * ) Notice: Subject to any disclaimer, the term of this patent is extended or adjusted under 35 U.S.C. 154(b) by 610 days.

(21) Appl. No.: 17/291,342

(22) PCT Filed: Oct. 1, 2019

(86) PCT No.: PCT/GB2019/052766
§ 371 (c)(1),
(2) Date: May 5, 2021

(87) PCT Pub. No.: WO2020/095019
PCT Pub. Date: May 14, 2020

(65) Prior Publication Data

US 2021/0392957 A1 Dec. 23, 2021

(30) Foreign Application Priority Data

Nov. 5, 2018 (GB) ..... 1818007

(51) Int. Cl.
*A24F 40/57* (2020.01)
*A24F 40/51* (2020.01)
(Continued)

(52) U.S. Cl.
CPC ..... *A24F 40/57* (2020.01); *A24F 40/51* (2020.01); *A24F 40/53* (2020.01); *A24F 40/60* (2020.01)

(58) Field of Classification Search
CPC ..... A24F 40/57; A24F 40/60; A24F 40/51; A24F 40/53
(Continued)

(56) References Cited

U.S. PATENT DOCUMENTS 9,949,507 B2 * 4/2018 Flick ..... A24F 40/50
9,993,602 B2 6/2018 Davidson et al.
(Continued)

FOREIGN PATENT DOCUMENTS

AU 2015221945 A1 9/2016
CA 2851933 A1 5/2013
(Continued)

OTHER PUBLICATIONS

Search Report for GB Application No. GB1818007.5, Mar. 27, 2019, 4 pages.
(Continued)

*Primary Examiner* — Abdullah A Riyami
*Assistant Examiner* — Vladimir Imas
(74) *Attorney, Agent, or Firm* — Burr & Forman LLP

(57) ABSTRACT

A temperature regulating system for an electronic vapor provision system (EVPS) comprises a sensor to detect at least one parameter of the airflow within the EVPS; a user interface adapted to receive an indication from a user that a puff of the EVPS was too hot; and a processor adapted to change at least a first aspect of a vapor generation process to reduce the vapor temperature at the mouthpiece, based upon sensor data from the at least one parameter of the airflow, in response to the received indication.

22 Claims, 7 Drawing Sheets

(51) Int. Cl.
*A24F 40/53* (2020.01)
*A24F 40/60* (2020.01)

(58) Field of Classification Search
USPC ..... 131/329
See application file for complete search history.

(56) References Cited

U.S. PATENT DOCUMENTS

| | | | | |
|---|---|---|---|---|
| 10,244,793 | B2 * | 4/2019 | Monsees | H05B 3/146 |
| 10,512,282 | B2 * | 12/2019 | Bowen | G01N 33/0027 |
| 11,317,654 | B2 * | 5/2022 | Karles | B01J 20/103 |
| 2008/0092912 | A1 * | 4/2008 | Robinson | H05B 3/42 131/200 |
| 2016/0366939 | A1 | 12/2016 | Alarcon et al. | |
| 2017/0127728 | A1 | 5/2017 | Li et al. | |
| 2017/0135412 | A1 * | 5/2017 | Cameron | A24F 40/51 |
| 2017/0251728 | A1 | 9/2017 | Peleg et al. | |
| 2018/0140008 | A1 | 5/2018 | Sur et al. | |
| 2018/0199630 | A1 | 7/2018 | Qiu | |
| 2018/0235282 | A1 | 8/2018 | Gao et al. | |
| 2020/0323274 | A1 | 10/2020 | Qiu et al. | |

FOREIGN PATENT DOCUMENTS

| | | | |
|---|---|---|---|
| CN | 205180369 | U | 4/2016 |
| CN | 107713016 | A | 2/2018 |
| CN | 107898008 | A | 4/2018 |
| GB | 2533137 | A | 6/2016 |
| GB | 2542011 | A | 3/2017 |
| RU | 2639637 | C1 | 12/2017 |
| TW | 201322935 | | 6/2013 |
| WO | WO-2014060267 | A2 | 4/2014 |
| WO | 2015107552 | A1 | 7/2015 |
| WO | WO-2017084489 | A1 | 5/2017 |
| WO | 2017121979 | A1 | 7/2017 |
| WO | 2018069673 | A1 | 4/2018 |
| WO | WO-2018071337 | A1 | 4/2018 |
| WO | WO-2018190590 | A2 | 10/2018 |

OTHER PUBLICATIONS

International Search Report and Written Opinion for PCT Application No. PCT/GB2019/052766, Jan. 7, 2020, 14 pages.
Office Action for Canadian Application No. 3, 118,644, mailed on Aug. 3, 2022, 9 pages.
Office Action For Russian Application No. 2021112173, mailed on Nov. 18, 2021, 9 pages.

* cited by examiner

TEMPERATURE REGULATING SYSTEM FOR AN ELECTRONIC VAPOR PROVISION SYSTEM

PRIORITY CLAIM

The present application is a National Phase entry of PCT Application No. PCT/GB2019/052766, filed Oct. 1, 2019, which claims priority from Great Britain Application No. 1818007.5, filed Nov. 5, 2018, each of which is hereby fully incorporated herein by reference.

TECHNICAL FIELD

The present invention relates to a device calibration and method.

BACKGROUND

Electronic vapor provision systems (EVPSs), such as e-cigarettes and other aerosol delivery systems, are complex devices comprising a power source sufficient to vaporize a volatile material, together with control circuitry, a heating element and typically a liquid payload. Some EVPSs also comprise communication systems or computing capabilities.

In use, the device is intended to deliver a vapor comprising the volatile material to the user for inhalation, typically by heating a portion of the payload to a sufficient temperature to vaporize the volatile material.

However some users, whether due to individual sensitivity or due to an unusual inhalation pattern, can find the resulting vapor to be too hot.

The present invention seeks to alleviate or mitigate this problem.

SUMMARY

In some aspects, the disclosure describes a temperature regulating system of an electronic vapor provision system (EVPS), that includes a sensor to detect at least one parameter of the airflow within the EVPS; a user interface adapted to receive an indication from a user that a puff of the EVPS was too hot; and a processor adapted to change at least a first aspect of a vapor generation process to reduce a vapor temperature at the mouthpiece, based upon sensor data from the at least one parameter of the airflow, in response to the received indication.

In another aspect, the disclosure describes a method of regulating temperature of an electronic vapor provision system (EVPS) that includes the steps of obtaining airflow sensor data from a sensor operable to detect at least one parameter of the airflow within the EVPS, detecting whether an indication from a user that a puff of the EVPS was too hot is received; and in response to detecting the indication, changing at least a first aspect of a vapor generation process to reduce a vapor temperature at the mouthpiece, based upon sensor data from the at least one parameter of the airflow. The disclosure also describes a computer readable medium having computer executable instructions adapted to cause a computer system to perform said method.

BRIEF DESCRIPTION OF THE DRAWINGS

Embodiments of the present invention will now be described by way of example with reference to the accompanying drawings, in which.

DETAILED DESCRIPTION

A device calibration and method are disclosed. In the following description, a number of specific details are presented in order to provide a thorough understanding of the embodiments of the present invention. It will be apparent, however, to a person skilled in the art that these specific details need not be employed to practice the present invention. Conversely, specific details known to the person skilled in the art are omitted for the purposes of clarity where appropriate.

By way of background explanation, electronic vapor provision systems, such as e-cigarettes and other aerosol delivery systems, generally contain a reservoir of liquid which is to be vaporized, typically nicotine (this is sometimes referred to as an "e-liquid"). When a user inhales on the device, an electrical (e.g. resistive) heater is activated to vaporize a small amount of liquid, in effect producing an aerosol which is therefore inhaled by the user. The liquid may comprise nicotine in a solvent, such as ethanol or water, together with glycerin or propylene glycol to aid aerosol formation, and may also include one or more additional flavors. The skilled person will be aware of many different liquid formulations that may be used in e-cigarettes and other such devices.

The practice of inhaling vaporized liquid in this manner is commonly known as 'vaping'.

An e-cigarette may have an interface to support external data communications. This interface may be used, for example, to load control parameters or updated software onto the e-cigarette from an external source. Alternatively or additionally, the interface may be utilized to download data from the e-cigarette to an external system. The downloaded data may, for example, represent usage parameters of the e-cigarette, fault conditions, etc. As the skilled person will be aware, many other forms of data can be exchanged between an e-cigarette and one or more external systems (which may be another e-cigarette).

In some cases, the interface for an e-cigarette to perform communication with an external system is based on a wired connection, such as a USB link using a micro, mini, or ordinary USB connection into the e-cigarette. The interface for an e-cigarette to perform communication with an external system may also be based on a wireless connection. Such a wireless connection has certain advantages over a wired connection. For example, a user does not need any additional cabling to form such a connection. In addition, the user has more flexibility in terms of movement, setting up a connection, and the range of pairing devices.

Throughout the present description the term "e-cigarette" is used; however, this term may be used interchangeably with electronic vapor provision system, aerosol delivery device, and other similar terminology.

Figure 1:
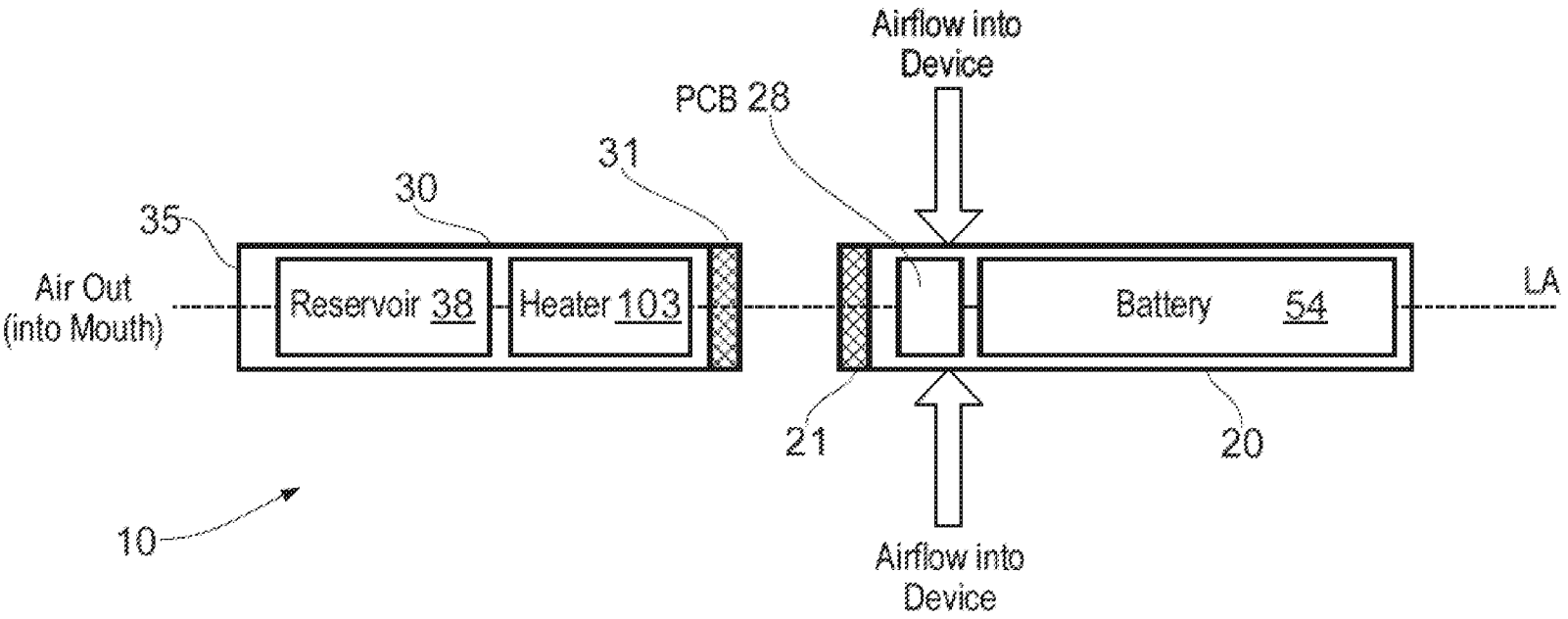
FIG. 1 is a schematic diagram of an e-cigarette in accordance with embodiments of the present invention.

FIG. 1 is a schematic (exploded) diagram of an e-cigarette 10 in accordance with some embodiments of the disclosure (not to scale). The e-cigarette comprises a body or control unit 20 and a cartomizer 30. The cartomizer 30 includes a reservoir 38 of liquid, typically including nicotine, a heater 36, and a mouthpiece 35. The e-cigarette 10 has a longitudinal or cylindrical axis which extends along the center-line of the e-cigarette from the mouthpiece 35 at one end of the cartomizer 30 to the opposing end of the control unit 20 (usually referred to as the tip end). This longitudinal axis is indicated in FIG. 1 by the dashed line denoted LA.

The liquid reservoir 38 in the cartomizer may hold the (e-)liquid directly in liquid form, or may utilize some absorbing structure, such as a foam matrix or cotton material, etc, as a retainer for the liquid. The liquid is then fed from the reservoir 38 to be delivered to a vaporizer comprising the heater 36. For example, liquid may flow via capillary action from the reservoir 38 to the heater 36 via a wick (not shown in FIG. 1).

In other devices, the liquid may be provided in the form of plant material or some other (ostensibly solid) plant derivative material. In this case the liquid can be considered as representing volatiles in the material which vaporize when the material is heated. Note that devices containing this type of material generally do not require a wick to transport the liquid to the heater, but rather provide a suitable arrangement of the heater in relation to the material to provide suitable heating.

It will also be appreciated that forms of payload delivery other than a liquid may be equally considered, such as heating a solid material (such as processed tobacco leaf) or a gel. In such cases, the volatiles that vaporize provide the active ingredient of the vapor/aerosol to be inhaled. It will be understood that references herein to 'liquid', 'e-liquid' and the like equally encompass other modes of payload delivery, and similarly references to 'reservoir' or similar equally encompass other means of storage, such as a container for solid materials.

The control unit 20 includes a re-chargeable cell or battery 54 to provide power to the e-cigarette 10 (referred to hereinafter as a battery) and a printed circuit board (PCB) 28 or other electronics for generally controlling the e-cigarette.

The control unit 20 and the cartomizer 30 are detachable from one another, as shown in FIG. 1, but are joined together when the device 10 is in use, for example, by a screw or bayonet fitting. The connectors on the cartomizer 30 and the control unit 20 are indicated schematically in FIG. 1 as 31B and 21A respectively. This connection between the control unit and cartomizer provides for mechanical and electrical connectivity between the two.

When the control unit is detached from the cartomizer, the electrical connection 21A on the control unit that is used to connect to the cartomizer may also serve as a socket for connecting a charging device (not shown). The other end of this charging device can be plugged into a USB socket to re-charge the battery 54 in the control unit of the e-cigarette. In other implementations, the e-cigarette may be provided (for example) with a cable for direct connection between the electrical connection 21A and a USB socket.

The control unit is provided with one or more holes for air inlet adjacent to PCB 28. These holes connect to an air passage through the control unit to an air passage provided through the connector 21A. This then links to an air path through the cartomizer 30 to the mouthpiece 35. Note that the heater 36 and the liquid reservoir 38 are configured to provide an air channel between the connector 31B and the mouthpiece 35. This air channel may flow through the center of the cartomizer 30, with the liquid reservoir 38 confined to an annular region around this central path. Alternatively (or additionally) the airflow channel may lie between the liquid reservoir 38 and an outer housing of the cartomizer 30.

When a user inhales through the mouthpiece 35, air is drawn into the control unit 20 through the one or more air inlet holes. This airflow (or the associated change in pressure) is detected by a sensor, e.g. a pressure sensor, which in turn activates the heater 36 to vaporize the nicotine liquid fed from the reservoir 38. The airflow passes from the control unit into the vaporizer, where the airflow combines with the nicotine vapor. This combination of airflow and nicotine vapor (in effect, an aerosol) then passes through the cartomizer 30 and out of the mouthpiece 35 to be inhaled by a user. The cartomizer 30 may be detached from the control unit and disposed of when the supply of nicotine liquid is exhausted (and then replaced with another cartomizer).

It will be appreciated that the e-cigarette 10 shown in FIG. 1 is presented by way of example only, and many other implementations may be adopted. For example, in some implementations, the cartomizer 30 is split into a cartridge containing the liquid reservoir 38 and a separate vaporizer portion containing the heater 36. In this configuration, the cartridge may be disposed of after the liquid in reservoir 38 has been exhausted, but the separate vaporizer portion containing the heater 36 is retained. Alternatively, an e-cigarette may be provided with a cartomizer 30 as shown in FIG. 1, or else constructed as a one-piece (unitary) device, but the liquid reservoir 38 is in the form of a (user-)replaceable cartridge. Further possible variations are that the heater 36 may be located at the opposite end of the cartomizer 30 from that shown in FIG. 1, e.g. between the liquid reservoir 38 and the mouthpiece 35, or else the heater 36 is located along a central axis LA of the cartomizer, and the liquid reservoir is in the form of an annular structure which is radially outside the heater 35.

The skilled person will also be aware of a number of possible variations for the control unit 20. For example, airflow may enter the control unit at the tip end, e.g. the opposite end to connector 21A, in addition to or instead of the airflow adjacent to PCB 28. In this case the airflow would typically be drawn towards the cartomizer along a passage between the battery 54 and the outer wall of the control unit. Similarly, the control unit may comprise a PCB located on or near the tip end, e.g. between the battery and the tip end. Such a PCB may be provided in addition to or instead of PCB 28.

Furthermore, an e-cigarette may support charging at the tip end, or via a socket elsewhere on the device, in addition to or in place of charging at the connection point between the cartomizer and the control unit. (It will be appreciated that some e-cigarettes are provided as essentially integrated units, in which case a user is unable to disconnect the cartomizer from the control unit). Other e-cigarettes may also support wireless (induction) charging, in addition to (or instead of) wired charging.

The above discussion of potential variations to the e-cigarette shown in FIG. 1 is by way of example. The skilled person will aware of further potential variations (and combination of variations) for the e-cigarette 10.

Figure 2:
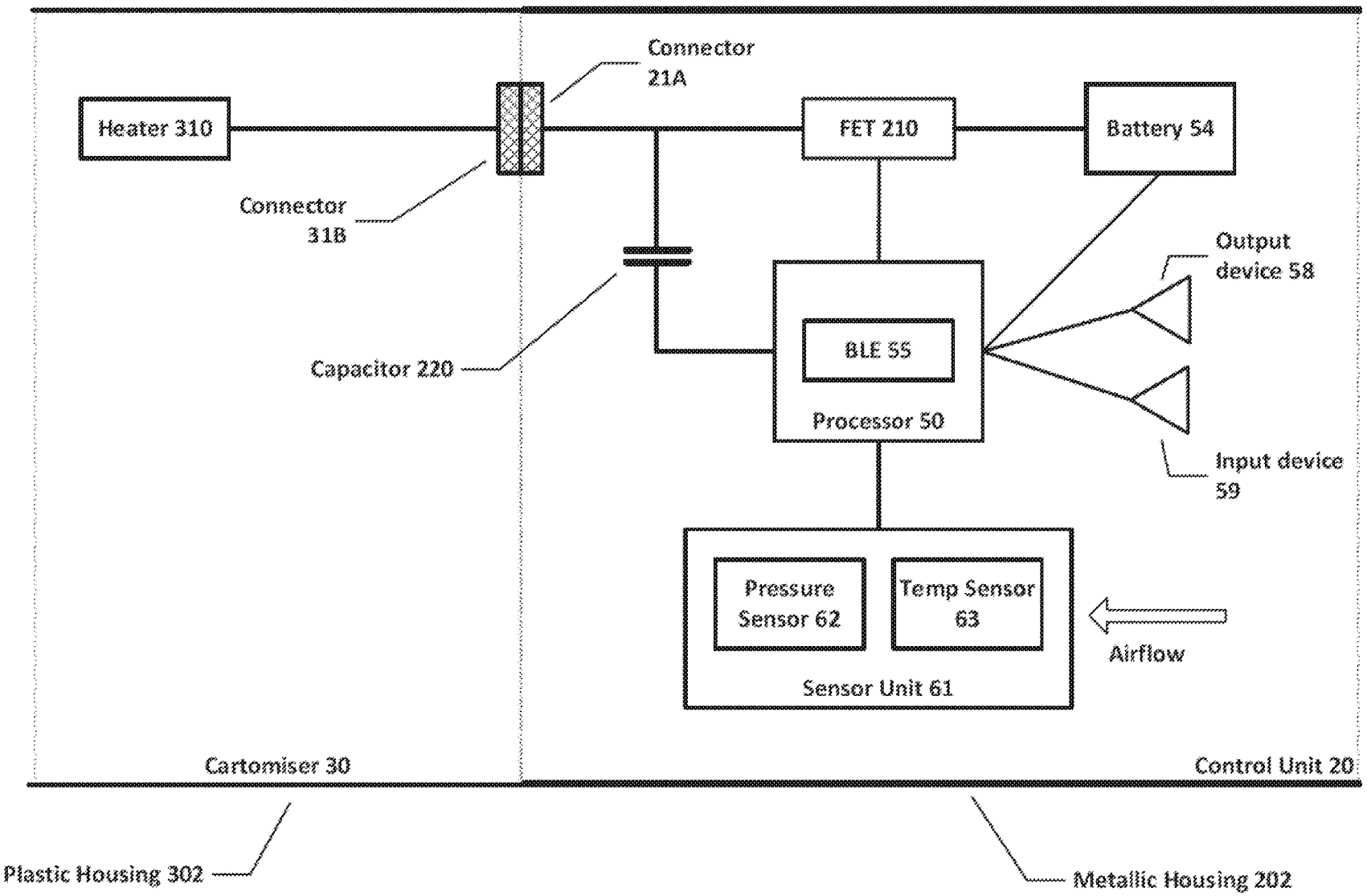
FIG. 2 is a schematic diagram of a control unit of an e-cigarette in accordance with embodiments of the present invention.

FIG. 2 is a schematic diagram of the main functional components of the e-cigarette 10 of FIG. 1 in accordance with some embodiments of the disclosure. N. B. FIG. 2 is primarily concerned with electrical connectivity and functionality—it is not intended to indicate the physical sizing of the different components, nor details of their physical placement within the control unit 20 or cartomizer 30. In addition, it will be appreciated that at least some of the components shown in FIG. 2 located within the control unit 20 may be mounted on the circuit board 28. Alternatively, one or more of such components may instead be accommodated in the control unit to operate in conjunction with the circuit board 28, but not physically mounted on the circuit board itself. For example, these components may be located on one or more additional circuit boards, or they may be separately located (such as battery 54).

As shown in FIG. 2, the cartomizer contains heater 310 which receives power through connector 31B. The control unit 20 includes an electrical socket or connector 21A for connecting to the corresponding connector 31B of the cartomizer 30 (or potentially to a USB charging device). This then provides electrical connectivity between the control unit 20 and the cartomizer 30.

The control unit 20 further includes a sensor unit 61, which is located in or adjacent to the air path through the control unit 20 from the air inlet(s) to the air outlet (to the cartomizer 30 through the connector 21A). The sensor unit contains a pressure sensor 62 and temperature sensor 63 (also in or adjacent to this air path). The control unit further includes a capacitor 220, a processor 50, a field effect transistor (FET) switch 210, a battery 54, and input and output devices 59, 58.

The operations of the processor 50 and other electronic components, such as the pressure sensor 62, are generally controlled at least in part by software programs running on the processor (or other components). Such software programs may be stored in non-volatile memory, such as ROM, which can be integrated into the processor 50 itself, or provided as a separate component. The processor 50 may access the ROM to load and execute individual software programs as and when required. The processor 50 also contains appropriate communications facilities, e.g. pins or pads (plus corresponding control software), for communicating as appropriate with other devices in the control unit 20, such as the pressure sensor 62.

The output device(s) 58 may provide visible, audio or haptic output. For example, the output device(s) may include a speaker 58, a vibrator, or one or more lights. The lights are typically provided in the form of one or more light emitting diodes (LEDs), which may be the same or different colors (or multi-colored). In the case of multi-colored LEDs, different colors are obtained by switching different colored, e.g. red, green or blue, LEDs on, optionally at different relative brightnesses to give corresponding relative variations in color. Where red, green and blue LEDs are provided together, a full range of colors is possible, whilst if only two out of the three red, green and blue LEDs are provided, only a respective sub-range of colors can be obtained.

The output from the output device may be used to signal to the user various conditions or states within the e-cigarette, such as a low battery warning. Different output signals may be used for signaling different states or conditions. For example, if the output device 58 is an audio speaker, different states or conditions may be represented by tones or beeps of different pitch, duration, or by providing multiple such beeps or tones. Alternatively, if the output device 58 includes one or more lights, different states or conditions may be represented by using different colors, pulses of light or continuous illumination, different pulse durations, and so on. For example, one indicator light might be utilized to show a low battery warning, while another indicator light might be used to indicate that the liquid reservoir 38 is nearly depleted. It will be appreciated that a given e-cigarette may include output devices to support multiple different output modes (audio, visual) etc.

The input device(s) 59 may be provided in various forms. For example, an input device (or devices) may be implemented as buttons on the outside of the e-cigarette—e.g. as mechanical, electrical or capacitive (touch) sensors. Some devices may support blowing into the e-cigarette as an input mechanism (such blowing may be detected by pressure sensor 62, which would then be also acting as a form of input device 59), or connecting/disconnecting the cartomizer 30 and control unit 20 as another form of input mechanism. Again, it will be appreciated that a given e-cigarette may include input devices 59 to support multiple different input modes.

As noted above, the e-cigarette 10 provides an air path from the air inlet through the e-cigarette, past the pressure sensor 62 and the heater 310 in the cartomizer 30 to the mouthpiece 35. Thus when a user inhales on the mouthpiece of the e-cigarette, the processor 50 detects such inhalation based on information from the pressure sensor 62. In response to such a detection, the CPU supplies power from the battery 54 to the heater, which thereby heats and vaporizes the nicotine from the liquid reservoir 38 for inhalation by the user.

In the particular implementation shown in FIG. 2, a FET 210 is connected between the battery 54 and the connector 21A. This FET 210 acts as a switch. The processor 50 is connected to the gate of the FET to operate the switch, thereby allowing the processor to switch on and off the flow of power from the battery 54 to heater 310 according to the status of the detected airflow. It will be appreciated that the heater current can be relatively large, for example, in the range 1-5 amps, and hence the FET 210 should be implemented to support such current control (likewise for any other form of switch that might be used in place of FET 210).

In order to provide more fine-grained control of the amount of power flowing from the battery 54 to the heater 310, a pulse-width modulation (PWM) scheme may be adopted. A PWM scheme may be based on a repetition period of say 1 ms. Within each such period, the switch 210 is turned on for a proportion of the period, and turned off for the remaining proportion of the period. This is parameterized by a duty cycle, whereby a duty cycle of 0 indicates that the switch is off for all of each period (e.g. in effect, permanently off), a duty cycle of 0.33 indicates that the switch is on for a third of each period, a duty cycle of 0.66 indicates that the switch is on for two-thirds of each period, and a duty cycle of 1 indicates that the FET is on for all of each period (e.g. in effect, permanently on). It will be appreciated that these are only given as example settings for the duty cycle, and intermediate values can be used as appropriate.

The use of PWM provides an effective power to the heater which is given by the nominal available power (based on the battery output voltage and the heater resistance) multiplied by the duty cycle. The processor 50 may, for example, utilize a duty cycle of 1 (e.g. full power) at the start of an inhalation to initially raise the heater 310 to its desired operating temperature as quickly as possible. Once this desired operating temperature has been achieved, the processor 50 may then reduce the duty cycle to some suitable value in order to supply the heater 310 with the desired operating power As shown in FIG. 2, the processor 50 includes a communications interface 55 for wireless communications, in particular, support for Bluetooth® Low Energy (BLE) communications.

Optionally the heater 310 may be utilized as an antenna for use by the communications interface 55 for transmitting and receiving the wireless communications. One motivation for this is that the control unit 20 may have a metal housing 202, whereas the cartomizer portion 30 may have a plastic housing 302 (reflecting the fact that the cartomizer 30 is disposable, whereas the control unit 20 is retained and therefore may benefit from being more durable). The metal housing acts as a screen or barrier which can affect the operation of an antenna located within the control unit 20 itself. However, utilizing the heater 310 as the antenna for the wireless communications can help to avoid this metal screening because of the plastic housing of the cartomizer, but without adding additional components or complexity (or cost) to the cartomizer. Alternatively a separate antenna may be provided (not shown), or a portion of the metal housing may be used.

If the heater is used as an antenna then as shown in FIG. 2, the processor 50, more particularly the communications interface 55, may be coupled to the power line from the battery 54 to the heater 310 (via connector 31B) by a capacitor 220. This capacitive coupling occurs downstream of the switch 210, since the wireless communications may operate when the heater is not powered for heating (as discussed in more detail below). It will be appreciated that capacitor 220 helps prevent the power supply from the battery 54 to the heater 310 being diverted back to the processor 50.

Note that the capacitive coupling may be implemented using a more complex LC (inductor-capacitor) network, which can also provide impedance matching with the output of the communications interface 55. (As known to the person skilled in the art, this impedance matching can help support proper transfer of signals between the communications interface 55 and the heater 310 acting as the antenna, rather than having such signals reflected back along the connection).

In some implementations, the processor 50 and communications interface are implemented using a Dialog DA14580 chip from Dialog Semiconductor PLC, based in Reading, United Kingdom. Further information (and a data sheet) for this chip is available at: http://www.dialog-semiconductor.com/products/bluetooth-smart/smartbond-da14580.

Figure 3:
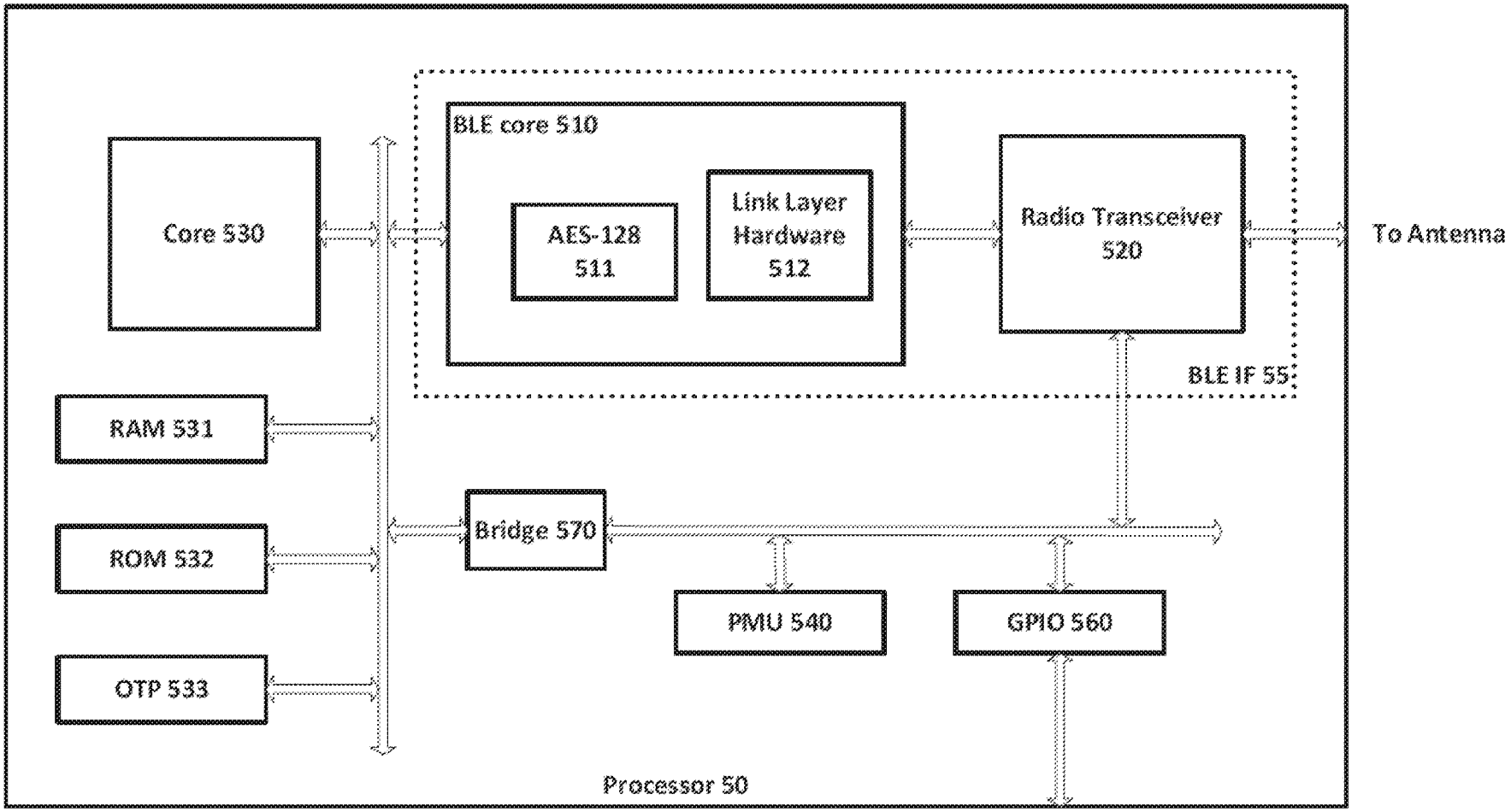
FIG. 3 is a schematic diagram of a processor of an e-cigarette in accordance with embodiments of the present invention.

FIG. 3 presents a high-level and simplified overview of this chip 50, including the communications interface 55 for supporting Bluetooth® Low Energy. This interface includes in particular a radio transceiver 520 for performing signal modulation and demodulation, etc, link layer hardware 512, and an advanced encryption facility (128 bits) 511. The output from the radio transceiver 520 is connected to the antenna (for example, to the heater 310 acting as the antenna via capacitive coupling 220 and connectors 21A and 31B).

The remainder of processor 50 includes a general processing core 530, RAM 531, ROM 532, a one-time programming (OTP) unit 533, a general purpose I/O system 560 (for communicating with other components on the PCB 28), a power management unit 540 and a bridge 570 for connecting two buses. Software instructions stored in the ROM 532 or OTP unit 533 may be loaded into RAM 531 (or into memory provided as part of core 530) for execution by one or more processing units within core 530. These software instructions cause the processor 50 to implement various functionality described herein, such as interfacing with the sensor unit 61 and controlling the heater accordingly. Note that although the device shown in FIG. 3 acts as both a communications interface 55 and also as a general controller for the electronic vapor provision system 10, in other embodiments these two functions may be split between two or more different devices (chips)—e.g. one chip may serve as the communications interface 55, and another chip as the general controller for the electronic vapor provision system 10.

In some implementations, the processor 50 may be configured to prevent wireless communications when the heater is being used for vaporizing liquid from reservoir 38. For example, wireless communications may be suspended, terminated or prevented from starting when switch 210 is switched on. Conversely, if wireless communications are ongoing, then activation of the heater may be prevented—e.g. by disregarding a detection of airflow from the sensor unit 61, or by not operating switch 210 to turn on power to the heater 310 while the wireless communications are progressing.

One reason for preventing the simultaneous operation of heater 310 for both heating and wireless communications in some implementations is to help avoid potential interference from the PWM control of the heater. This PWM control has its own frequency (based on the repetition frequency of the pulses), albeit typically much lower than the frequency used for the wireless communications, and the two could potentially interfere with one another. In some situations, such interference may not, in practice, cause any problems, and simultaneous operation of heater 310 for both heating and wireless communications may be allowed (if so desired). This may be facilitated, for example, by techniques such as the appropriate selection of signal strengths or PWM frequency, the provision of suitable filtering, etc.

Figure 4:
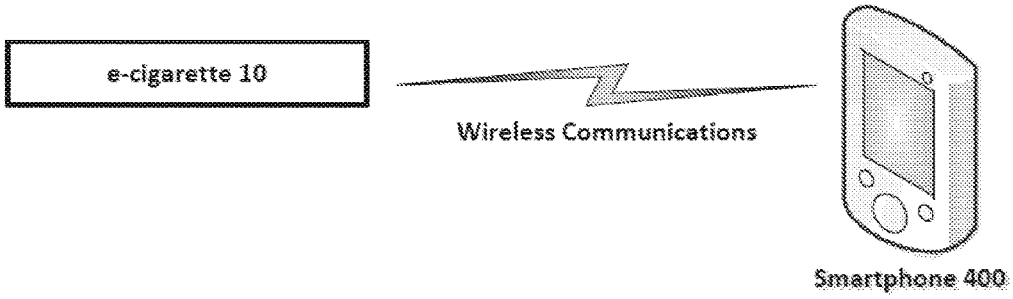
FIG. 4 is a schematic diagram of an e-cigarette in communication with a mobile terminal in accordance with embodiments of the present invention.

FIG. 4 is a schematic diagram showing Bluetooth® Low Energy communications between an e-cigarette 10 and an application (app) running on a smartphone 400 or other suitable mobile communication device (tablet, laptop, smartwatch, etc). Such communications can be used for a wide range of purposes, for example, to upgrade firmware on the e-cigarette 10, to retrieve usage or diagnostic data from the e-cigarette 10, to reset or unlock the e-cigarette 10, to control settings on the e-cigarette, etc.

In general terms, when the e-cigarette 10 is switched on, such as by using input device 59, or possibly by joining the cartomizer 30 to the control unit 20, it starts to advertise for Bluetooth® Low Energy communication. If this outgoing communication is received by smartphone 400, then the smartphone 400 requests a connection to the e-cigarette 10. The e-cigarette may notify this request to a user via output device 58, and wait for the user to accept or reject the request via input device 59. Assuming the request is accepted, the e-cigarette 10 is able to communicate further with the smartphone 400. Note that the e-cigarette may remember the identity of smartphone 400 and be able to accept future connection requests automatically from that smartphone. Once the connection has been established, the smartphone 400 and the e-cigarette 10 operate in a client-server mode, with the smartphone operating as a client that initiates and sends requests to the e-cigarette which therefore operates as a server (and responds to the requests as appropriate).

A Bluetooth® Low Energy link (also known as Bluetooth Smart®) implements the IEEE 802.15.1 standard, and operates at a frequency of 2.4-2.5 GHz, corresponding to a wavelength of about 12 cm, with data rates of up to 1 Mbit/s. The set-up time for a connection is less than 6 ms, and the average power consumption can be very low—of the order 1 mW or less. A Bluetooth Low Energy link may extend up to some 50 m. However, for the situation shown in FIG. 4, the e-cigarette 10 and the smartphone 400 will typically belong to the same person, and will therefore be in much closer proximity to one another—e.g. 1 m. Further information about Bluetooth Low Energy can be found at: http://www.bluetooth.com/Pages/Bluetooth-Smart.aspx It will be appreciated that e-cigarette 10 may support other communications protocols for communication with smartphone 400 (or any other appropriate device). Such other communications protocols may be instead of, or in addition to, Bluetooth Low Energy. Examples of such other communications protocols include Bluetooth® (not the low energy variant), see for example, www.bluetooth.com, near field communications (NFC), as per ISO 13157, and WiFi®. NFC communications operate at much lower wavelengths than Bluetooth (13.56 MHz) and generally have a much shorter range—say <0.2 m. However, this short range is still compatible with most usage scenarios such as shown in FIG. 4. Meanwhile, low-power WiFi® communications, such as IEEE802.11ah, IEEE802.11v, or similar, may be employed between the e-cigarette 10 and a remote device. In each case, a suitable communications chipset may be included on PCB 28, either as part of the processor 50 or as a separate component. The skilled person will be aware of other wireless communication protocols that may be employed in e-cigarette 10.

Figure 5:
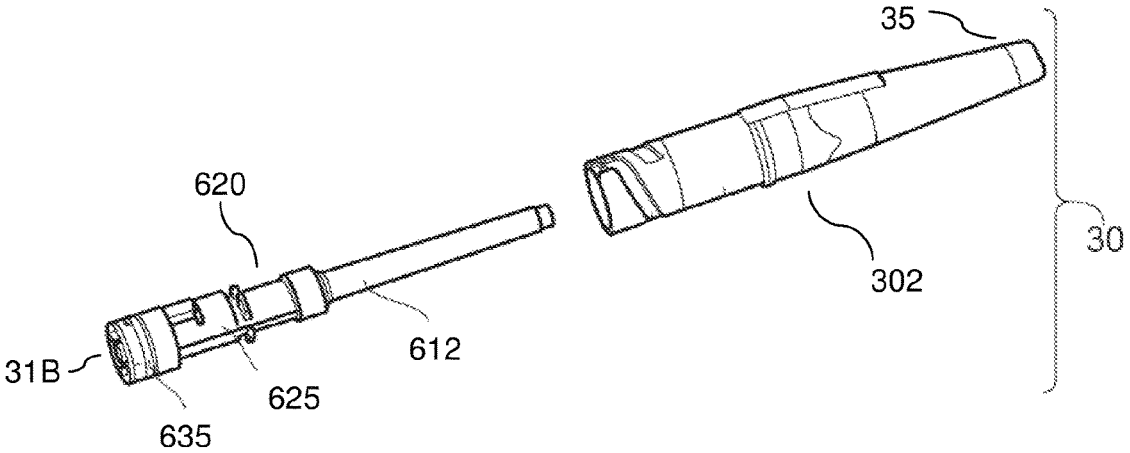
FIG. 5 is a schematic diagram of a cartomizer of an e-cigarette.

FIG. 5 is a schematic, exploded view of an example cartomizer 30 in accordance with some embodiments. The cartomizer has an outer plastic housing 302, a mouthpiece 35 (which may be formed as part of the housing), a vaporizer 620, a hollow inner tube 612, and a connector 31B for attaching to a control unit. An airflow path through the cartomizer 30 starts with an air inlet through connector 31B, then through the interior of vaporizer 625 and hollow tube 612, and finally out through the mouthpiece 35. The cartomizer 30 retains liquid in an annular region between (i) the plastic housing 302, and (ii) the vaporizer 620 and the inner tube 612. The connector 31B is provided with a seal 635 to help maintain liquid in this region and to prevent leakage.

Figure 6:
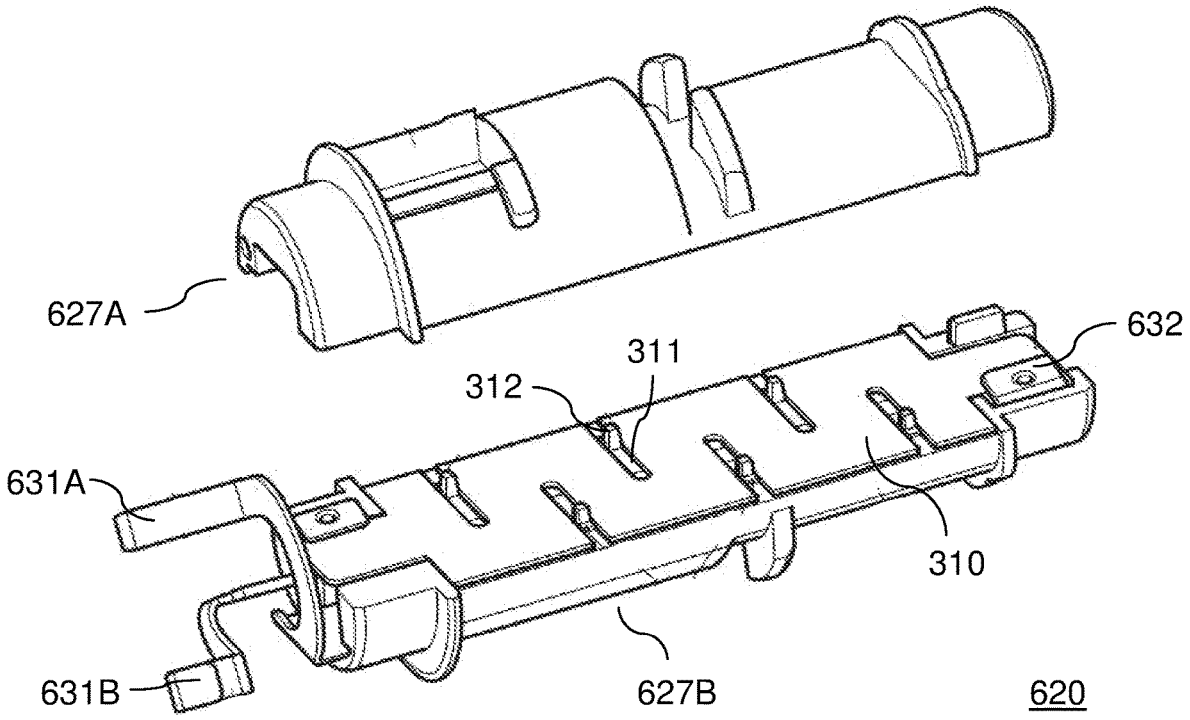
FIG. 6 is a schematic diagram of a vaporizer or heater of an e-cigarette.

FIG. 6 is a schematic, exploded view of the vaporizer 620 from the example cartomizer 30 shown in FIG. 5. The vaporizer 620 has a substantially cylindrical housing (cradle) formed from two components, 627A, 627B, each having a substantially semi-circular cross-section. When assembled, the edges of the components 627A, 627B do not completely abut one another (at least, not along their entire length), but rather a slight gap 625 remains (as indicated in FIG. 5). This gap allows liquid from the outer reservoir around the vaporizer and tube 612 to enter into the interior of the vaporizer 620.

One of the components 627B of the vaporizer is shown in FIG. 6 supporting a heater 310. There are two connectors 631A, 631B shown for supplying power (and a wireless communication signal) to the heater 310. More particular, these connectors 631A, 631B link the heater to connector 31B, and from there to the control unit 20. (Note that connector 631A is joined to pad 632A at the far end of vaporizer 620 from connector 31B by an electrical connection that passes under the heater 310 and which is not visible in FIG. 6).

The heater 310 comprises a heating element formed from a sintered metal fiber material and is generally in the form of a sheet or porous, conducting material (such as steel). However, it will be appreciated that other porous conducting materials may be used. The overall resistance of the heating element in the example of FIG. 6 is around 1 ohm. However, it will be appreciated that other resistances may be selected, for example having regard to the available battery voltage and the desired temperature/power dissipation characteristics of the heating element. In this regard, the relevant characteristics may be selected in accordance with the desired aerosol (vapor) generation properties for the device depending on the source liquid of interest.

The main portion of the heating element is generally rectangular with a length (e.g. in a direction running between the connector 31B and the contact 632A) of around 20 mm and a width of around 8 mm. The thickness of the sheet comprising the heating element in this example is around 0.15 mm.

As can be seen in FIG. 6, the generally-rectangular main portion of the heating element has slots 311 extending inwardly from each of the longer sides. These slots 311 engage pegs 312 provided by vaporizer housing component 627B, thereby helping to maintain the position of the heating element in relation to the housing components 627A, 627B.

The slots extend inwardly by around 4.8 mm and have a width of around 0.6 mm. The slots 311 extending inwardly are separated from one another by around 5.4 mm on each side of the heating element, with the slots extending inwardly from the opposing sides being offset from one another by around half this spacing. A consequence of this arrangement of slots is that current flow along the heating element is in effect forced to follow a meandering path, which results in a concentration of current and electrical power around the ends of the slots. The different current/power densities at different locations on the heating element mean there are areas of relatively high current density that become hotter than areas of relatively low current density. This in effect provides the heating element with a range of different temperatures and temperature gradients, which can be desirable in the context of aerosol provision systems. This is because different components of a source liquid may aerosolize/vaporize at different temperatures, and so providing a heating element with a range of temperatures can help simultaneously aerosolize a range of different components in the source liquid.

The heater 310 shown in FIG. 6, having a substantially planar shape which is elongated in one direction, is well-suited to act as an antenna. In conjunction with the metal housing 202 of the control unit, the heater 310 forms an approximate dipole configuration, which typically has a physical size of the same order of magnitude as the wavelength of Bluetooth Low Energy communications—e.g. a size of several centimeters (allowing for both the heater 310 and the metal housing 202) against a wavelength of around 12 cm.

Although FIG. 6 illustrates one shape and configuration of the heater 310 (heating element), the skilled person will be aware of various other possibilities. For example, the heater may be provided as a coil or some other configuration of resistive wire. Another possibility is that the heater is configured as a pipe containing liquid to be vaporized (such as some form of tobacco product). In this case, the pipe may be used primarily to transport heat from a place of generation (e.g. by a coil or other heating element) to the liquid to be vaporized. In such a case, the pipe still acts as a heater in respect of the liquid to be heated. Such configurations can again optionally be used as an antenna to support wireless configurations.

As was noted previously herein, a suitable e-cigarette 10 can communicate with a mobile communication device 400, for example by paring the devices using the Bluetooth® low energy protocol.

Consequently, it is possible to provide additional functionality to the e-cigarette or to a system comprising the e-cigarette and the smart phone, by providing suitable software instructions (for example in the form of an app) to run on the smart phone.

Figure 7:
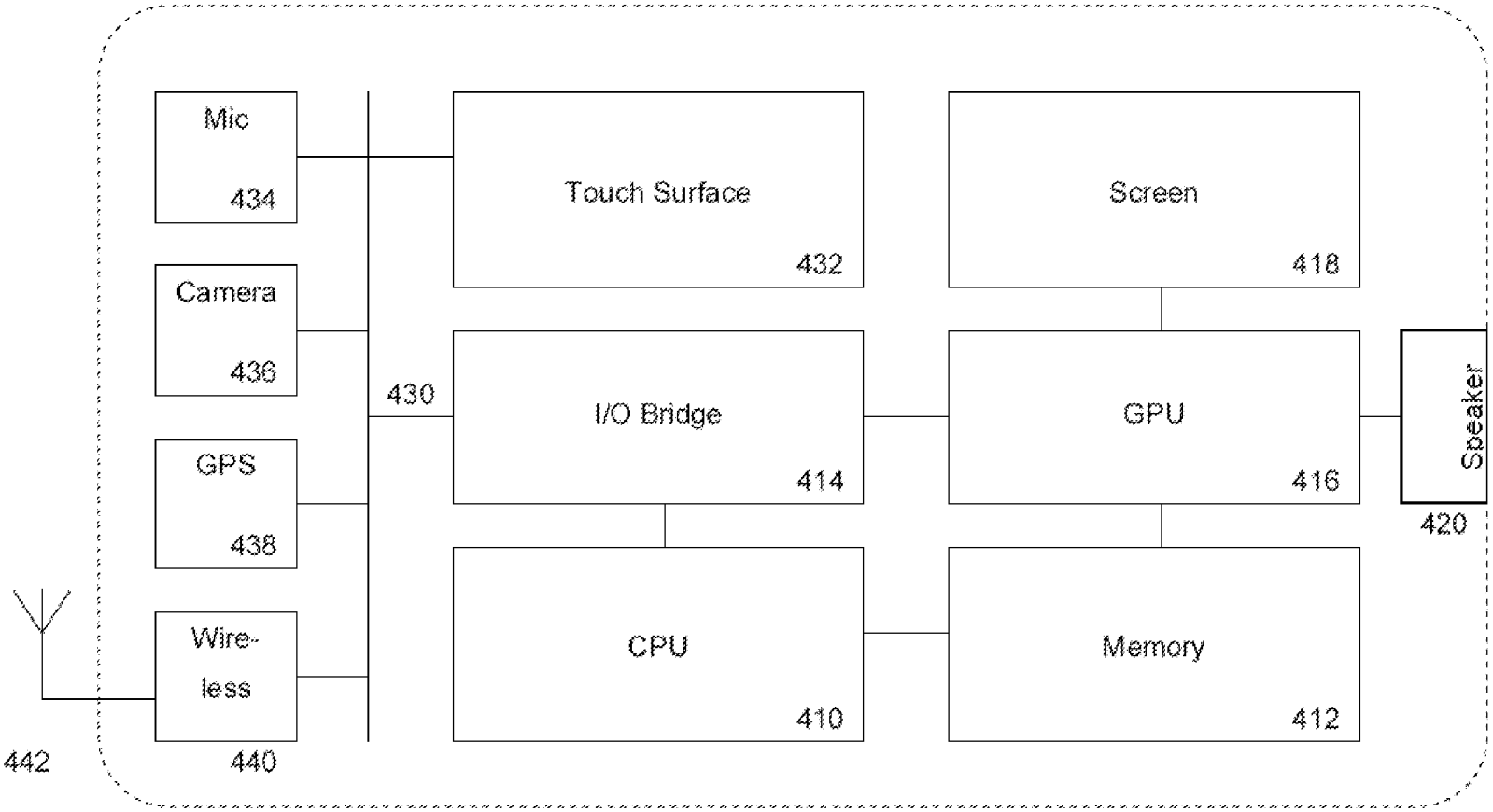
FIG. 7 is a schematic diagram of a mobile terminal in accordance with embodiments of the present invention.

Turning now to FIG. 7, a typical smartphone 400 comprises a central processing unit (CPU) (410). The CPU may communicate with components of the smart phone either through direct connections or via an I/O bridge 414 or a bus 430 as applicable.

In the example shown in FIG. 7, the CPU communicates directly with a memory 412, which may comprise a persistent memory such as for example Flash® memory for storing an operating system and applications (apps), and volatile memory such as RAM for holding data currently in use by the CPU. Typically persistent and volatile memories are formed by physically distinct units (not shown). In addition, the memory may separately comprise plug-in memory such as a microSD card, and also subscriber information data on a subscriber information module (SIM) (not shown).

The smart phone may also comprise a graphics processing unit (GPU) 416. The GPU may communicate directly with the CPU or via the I/O bridge, or may be part of the CPU. The GPU may share RAM with the CPU or may have its own dedicated RAM (not shown) and is connected to the display 418 of the mobile phone. The display is typically a liquid crystal (LCD) or organic light-emitting diode (OLED) display, but may be any suitable display technology, such as e-ink. Optionally the GPU may also be used to drive one or more loudspeakers 420 of the smart phone.

Alternatively, the speaker may be connected to the CPU via the I/O bridge and the bus. Other components of the smart phone may be similarly connected via the bus, including a touch surface 432 such as a capacitive touch surface overlaid on the screen for the purposes of providing a touch input to the device, a microphone 434 for receiving speech from the user, one or more cameras 436 for capturing images, a global positioning system (GPS) unit 438 for obtaining an estimate of the smart phones geographical position, and wireless communication means 440.

The wireless communication means 440 may in turn comprise several separate wireless communication systems adhering to different standards or protocols, such as Bluetooth® (standard or low-energy variants), near field communication and Wi-Fi® as described previously, and also phone based communication such as 2G, 3G or 4G.

The systems are typically powered by a battery (not shown) that may be chargeable via a power input (not shown) that in turn may be part of a data link such as USB (not shown).

It will be appreciated that different smartphones may include different features (for example a compass or a buzzer) and may omit some of those listed above (for example a touch surface).

Thus more generally, in an embodiment of the present disclosure a suitable remote device such as smart phone 400 will comprise a CPU and a memory for storing and running an app, and wireless communication means operable to instigate and maintain wireless communication with the e-cigarette 10. It will be appreciated however that the remote device may be a device that has these capabilities, such as a tablet, laptop, smart TV or the like.

In an embodiment of the present invention, a temperature regulating system for an electronic vapor provision system (EVPS) 10 (such as an e-cigarette) comprises a mouthpiece 35 optionally comprising a temperature sensor 63 thermally coupled to a flow path for vapor inhaled by a user. The EVPS also comprises a sensor 62 to detect at least one parameter of the airflow within the e-cigarette, optionally also within the mouthpiece, and typically between the mouthpiece and a heater of the EVPS. The system also comprises a user interface (418, 432) adapted to receive an indication from a user that a puff of the e-cigarette was too hot, and a processor (50, 410) adapted to change at least a first aspect of the vapor generation process to reduce the vapor temperature at the mouthpiece, based upon sensor data from the temperature sensor and the at least one parameter of the airflow.

Hence in operation, if the user signals that a given puff was too hot, for example by pressing a button (not shown) on the EVPS, or interacting with a touchscreen on a linked device, as described later herein, then the temperature regulating system uses the at least one parameter of the airflow, and optionally the temperature data, to reduce the chance of a repeat event by adjusting at least one operating parameter of the EVPS or by informing the user how to adapt their own behavior as an extended component of the overall inhalation system.

However, it will also be appreciated that a user should not be expected to be sufficiently familiar with vapor temperatures at the measurement point within the EVPS to be able to set a target temperature there that would have both a significant effect on the problem of a hot puff and not a negative impact on the vaporizing process. Furthermore, such a target temperature may not be appropriate in all circumstances.

Consequently embodiments of the present invention do not set a predetermined target temperature and then implement feedback to maintain that temperature during a puff. Rather, the system relies upon environmental data and an indication that the given puff was too hot to determine settings for subsequent environmental conditions that should avoid subsequent puffs being considered too hot.

It will be appreciated that an electronic vapor provision system (EVPS) will heat a payload (whether a liquid or gel for vaporization or a tobacco-based product for non-combustible heating to release volatiles), resulting in a vapor that is the combination of ambient air and aerosolized payload (here 'aerosolized' is treated as a general term for any payload or derivative of the payload mixed into the airflow either through vaporization, the release of volatiles or by any other suitable mechanism). As a result the vapor will have an above ambient temperature.

In a well-designed EVPS, the flow path between the heater and the mouthpiece will be of a sufficient length for the vapor to reach the mouthpiece at a temperature that is comfortable for typical users to then inhale.

However it will be appreciated that this design may be based upon certain assumptions that do not always hold true. These assumptions can relate to the environmental conditions in which the EVPS is used, or the manner in which the user themselves interacts with the device.

Environmental conditions that may affect the vapor temperature the mouthpiece may include for example the humidity of the ambient air (since water has a higher heat capacity than air and hence can retain and transfer more heat from the heater; a high proportion of water in the air can result in a higher heat capacity within the vapor and subsequently a greater transfer of heat to the user).

Similarly, the ambient air temperature can vary considerably across the globe, being at or below 0° in some countries while simultaneously more than 40° in others. It can be appreciated that introducing identical amounts of identically hot aerosolized payload into such different ambient air will result in a different overall vapor temperature at the mouthpiece.

Meanwhile, airflow rate can vary according to altitude and in particular due to instantaneous wind direction with respect to the air intakes of the EVPS. It will be appreciated that for a constant rate of heating, a lower airflow rate will result in proportionally more aerosolized payload per unit volume of air within the EVPS. As a result the mean temperature of that unit volume of air will be proportionally higher and hence may still be at an uncomfortable temperature at the mouthpiece, or similarly have a higher heat capacity due to the increased proportion of aerosolized payload that can be transferred to the user.

Meanwhile air pressure per se can be divided into two components static air pressure relating for example to altitude and weather is indicative of the density of air and hence may affect the amount of heat that can be transferred. Meanwhile dynamic air pressure within the context of an EVPS is a function of airflow rate, with more rapid airflow being associated with a drop in air pressure. Typically the range of variability for static air pressure will be small compared to the drop in air pressure due to airflow. Clearly also a change in pressure due to airflow can be calibrated or benchmarked against the static air pressure and so the dynamic component can be extracted and measured separately. In this way will be appreciated that airflow rate can be used as a proxy for dynamic pressure and vice versa.

In this case a drop in dynamic air pressure, being associated with an increase in airflow rate, is typically a good thing as it distributes the aerosolized payload over a greater volume of air. Conversely a drop in static air pressure reduces the density of ambient air and may also correspondingly reduce the vaporization temperature of the payload, meaning that for an identical heating action a larger amount of aerosolized payload may be generated and mixed with a smaller amount of air, again resulting in a larger potential transfer of heat to the user.

It will also be appreciated that dynamic air pressure, or similarly airflow rate, may be a function of the inhalation profile of the user themselves; if for example a user initially draws sharply on the EVPS to create an airflow rate or dynamic pressure drop sufficient to trigger heating of the payload, but then only inhales gently (what might be called a punctuated shallow inhalation), so that the airflow rate falls and the dynamic pressure rises, then a bolus of hot aerosolized payload may be delivered to a relatively small volume of air, generating a hot puff once it reaches the user.

Consequently, when a user indicates by the user interface that a puff was too hot, in embodiments of the present invention the temperature regulating system can assume either that an environmental factor has deviated from expected tolerances, or that the user inhalation profile needs correction.

In embodiments of the present invention, the processor can determine whether an environmental factor is a likely contributor. Hence in response to the received indication from the user that a puff of the EVPS was too hot, the processor can be adapted to detect whether a difference in the at least one parameter of the airflow deviates from an expected value by a predetermined amount, and if so, the processor can be adapted to change at least a first aspect of the vapor generation process responsive to the least one parameter of the airflow.

As discussed above, the at least one parameter of the airflow can be humidity, and if this is above an expected value by a predetermined amount (for example a humidity level above predetermined tolerances, where a greater amount of latent heat can expect to be stored by the combination of moist air and aerosolized payload), then the processor may be adapted to change one or more of an effective heating temperature of a heater of the EVPS and an effective air intake of the EVPS.

Similarly, the at least one parameter of the airflow can be ambient air temperature prior to heating, and if this is above an expected value by a predetermined amount (for example at a level above predetermined tolerances, where the additional contribution of a fixed heat level to the existing temperature can be expected to exceed a threshold level), the processor is adapted to change one or more of an effective heating temperature of a heater of the EVPS and an effective air intake of the EVPS.

Similarly, the at least one parameter of the airflow can be static air pressure, and if this is below an expected value by a predetermined amount (for example at a level where the air density may be insufficient to average out the heat of the hot aerosolized payload, or where the vaporization temperature of the payload will drop to an extent that too much hot aerosolized payload will be generated for the standard heating amount), the processor is adapted to change one or more of an effective heating temperature of a heater of the EVPS and an effective air intake of the EVPS.

In each case, the change may take the form of the processor being adapted to increase the effective air intake of the EVPS, for example by reducing a default constriction within the airflow path by use of an actuator, thereby increasing the airflow cross-section, or similarly opening an additional air intake channel, for example by use of a valve or similar actuator.

Alternatively or in addition, in each case, the change may take the form of the processor being adapted to reduce the effective heating temperature of the heater of the EVPS by a predetermined amount, the resulting effective heating temperature of the heater remaining above the vaporization temperature of a payload of the EVPS.

The predetermined amount may relate to the user indication, and either be fixed (e.g. steps of 10 degrees C. for each received indication), or proportional to a sliding scale of discomfort, where the user interface for the user provides such input (e.g. OK, too hot, and much too hot could result in different reductions of temperature).

Alternatively or in addition, the predetermined amount may relate to the extent by which the or each parameter of the airflow deviates from the expected norms, based on predefined relationships (for example empirically determined). Put another way, the processor may be adapted to reduce the effective heating temperature of the heater by an amount responsive to the difference between the detected and expected amount of the at least one parameter of the airflow.

Hence for example the effective heater temperature may be reduced by an amount corresponding to the extent to which the ambient temperature exceeds a predetermined threshold. Optionally if the user indicates a strong adverse reaction, the correspondence may be weighted by this indication to reduce the temperature further (or equivalently the predetermined threshold may be reduced). Similar relationships for an expected humidity threshold and static air pressure threshold may be envisaged.

Where multiple airflow parameters are measured, then multivariate solutions can be calculated; hence for example a high humidity may be offset in part by high air static pressure. Meanwhile a low static air pressure may allow the heater to be reduced to an even lower temperature due to a lower vaporization temperature, in response to excess in one of the other parameters.

It will also be appreciated that where a thermal sensor is incorporated into the mouthpiece of the EVPS, a direct temperature reading of vapor deemed by the user to be a hot puff can be obtained. A default temperature can be set that has been found empirically to be considered too hot for users, and this can be used trigger a virtual 'hot puff' user indication. Similarly, the mean temperature at which the user indicates a hot puff can be established over time (for example in response to the last N indications, optionally ignoring the lowest value), and this can similarly be used to trigger a virtual hot puff user indication, for example if the detected temperature is above this average by a predetermined amount. It will also be appreciated that this temperature reading can be used to detect the efficacy of the mitigating actions described herein, and optionally to provide feedback to achieve a mitigating action, for example to reduce vapor temperature at the mouthpiece by M degrees from the temperature at which a hot puff was indicated.

The processor may be adapted to reduce the effective heating temperature of the heater of the EVPS by one or more of reducing the heater temperature directly; changing a duty cycle of the heater (for example if the heater or power supply circuitry is fixed, the effective temperature can be changed in this way); and reducing a pre-heat temperature of the heater (where the heater takes a finite time to reach and possibly exceed a vaporization temperature, reducing a pre-heat level may reduce the time at which the heater is at a maximum temperature). Clearly any suitable combination of such techniques may be employed.

In addition to humidity, ambient temperature and static pressure, which may be assumed to be environmental, there is also airflow rate or dynamic air pressure, which may be environmental (e.g. due to wind) but is typically due to the inhalation behavior of the user.

In any event, as with the other environmental factors, if the at least one parameter of the airflow is air flow rate, and if this is below an expected value by a predetermined amount, then the processor may be similarly adapted to change one or more of an effective heating temperature of a heater of the EVPS; and an effective air intake of the EVPS, in a similar manner to that described previously herein.

Likewise, if the at least one parameter of the airflow is dynamic air pressure, and if this is above an expected value by a predetermined amount (e.g. due to insufficient airflow, optionally referenced to the current static air pressure), then the processor is adapted to change one or more selected from the list consisting of: an effective heating temperature of a heater of the EVPS; and an effective air intake of the EVPS, in a similar manner to that described previously herein. In embodiments of the present invention, optionally a sensor (either one used for any of the above sensor functions, or a separate sensor), may detect instantaneous airflow rates or a proxy thereof, such as dynamic air pressure, or potentially air/vapor temperature, which will vary as a function of airflow rate over the heater.

The processor may then be adapted to make instantaneous changes to the effective heating temperature of the heater of the EVPS in response to this sensor data. In this way, when the airflow rate drops, potentially raising the temperature of the inhaled air, then the heater can also reduce its temperature (without working range) to compensate, accepting that there will be some thermal lag.

Further, the processor may be adapted to model an inhalation profile of the user based upon instantaneous airflow rates detected by a sensor during inhalation, the inhalation profile being indicative of airflow rate during the course of an inhalation action by the user.

In other words, using airflow rate sensible data or a proxy for this as described above, the processor can build one or more models of the user's inhalation pattern or patterns. Where such a model shows inhalation may be that results in a low airflow rate at least during part of the inhalation action, it may be possible the processor to anticipate a hot puff and change at least a first aspect of the vapor generation process, as described previously herein, in response to the inhalation profile.

Hence for example a user who initially inhaled sharply, but then proceeds to inhale slowly or shallowly, will cause activation of the heater but then a slow flow across it, potentially resulting in a hot puff. Such a hot puff may in turn also be dependent on other factors measured by sensors where provided, such as ambient temperature, ambient static pressure, or humidity, and these may be included in the model or separate models may be made where any of these parameters that are used exceed a given threshold deviation from an expected value.

Consequently, if the user provides an indication of hot puff occurs, this can be associated with the inhalation profile. Furthermore, user provides multiple indications of hot puffs over the course of use, a counter, histogram or other measure of strength of association can be provided in association with the inhalation profile, thereby identifying inhalation profiles that are particularly problematic to the user.

In any event, where the user initiates an inhalation that appears to match an inhalation profile associated with a hot puff, the processor can take mitigating action during the generation process as described previously herein, for example by modifying airflow channels or heater behavior, so that the likelihood that the remainder of the inhalation action by the user will result in a hot puff is reduced.

However, if in order to modify the vapor generation process, either in response to an inhalation profile or in response to indication by a user that current environmental conditions are resulting in a hot puff, as described previously herein, the processor calculates a change for an effective temperature for the heater that would be below a vaporization temperature of a payload of the EVPS, then the system notifies the user. In other words, where a user's indication of hot puffs cannot be mitigated by available means within the normal operating parameters of the EVPS, the temperature regulating system will notify the user. The user may then decide either not to use the EVPS until environmental conditions change (for example until after coming in from a windy, hot or humid environment), or may decide to continue using the device whilst knowing and accepting that hot puffs are possible but have been minimized as far as the system allows.

The notification may take any suitable form, such as a warning light, alert sound, or haptic feedback such as a vibration built into the EVPS, alternatively where the EVPS is in communication with a remote device such as a mobile phone, tablet or similar, notification may be provided via such a device again for example in the form of warning light, alert sound or haptic feedback, or in the form of a message provided in a display of the mobile phone. Such a display could provide useful information such as the likely source of the hot puff being one or more environmental factors as described above, or due to an aspect of the inhalation profile of the user; in this latter case, the user then in a position to try inhaling in a different way.

It will be appreciated that where the EVPS is in communication with a remote device such as a mobile phone, then the processor may be located in this remote device, and hence the temperature regulation system is comprised of both the EVPS and the remote device. In this case, sensor data and the like may be transmitted from the EVPS, but subsequent analysis may be performed by the mobile phone, with subsequent commands to change one or more aspects of the vapor generation process being relayed back to the EVPS from the mobile phone. Similarly, inhalation profiles and the like can be assembled at the mobile phone and stored there. Such profiles and other related data about environmental and other operational parameters associated with hot puffs could in turn be associated with a user account, so that relevant information could be accessed by different phones or other remote devices (for example, a Bluetooth enabled car dashboard) when a user's registered EVPS pairs with them.

Finally, whilst the above description suggests that the processor makes adjustments to the vapor generation process in response to the hot puff notification, optionally alternatively or in addition the processor may provide instructions to the user as to how they can make alterations to settings of the EVPS to reduce the likelihood of a hot puff occurring. This may be the case where such alteration is not automatically actionable by the EVPS; for example, an air intake vent may be manually slidable by the user, but not controllable by the processor due to a lack of actuator within the EVPS; nevertheless the processor can inform the user by the user interface to adjust the air intake vent as appropriate.

Similarly, other parameters may be adjustable but outside direct control of the processor; for example if the user has installed a battery with a non-standard current, this may cause the EVPS to generate more heat than intended; the processor may detect such a high current and inform the user that the battery is non-standard and the cause of hot puffs. Similarly, the processor may suggest an alternative modification to the EVPS, such as the use of a longer mouthpiece, where such a mouthpiece is interchangeable, so that there is greater time for the vapor to mix and cool between the heater and the user's mouth.

Again similarly, the processor may provide feedback as to how the user could adjust their inhalation profile to reduce the chances of a hot puff, for example by illustrating the airflow rate of the user's inhalation, and suggesting where within the inhalation they can increase the airflow rate, or correspondingly decrease an initial airflow rate where this is used to set a heating temperature. The processor may provide a tutorial, for example tracing the instantaneous airflow rate against one or more inhalation templates, designed to reduce instances of hot puff for example through even inhalation at a moderate airflow rate.

Figure 8:
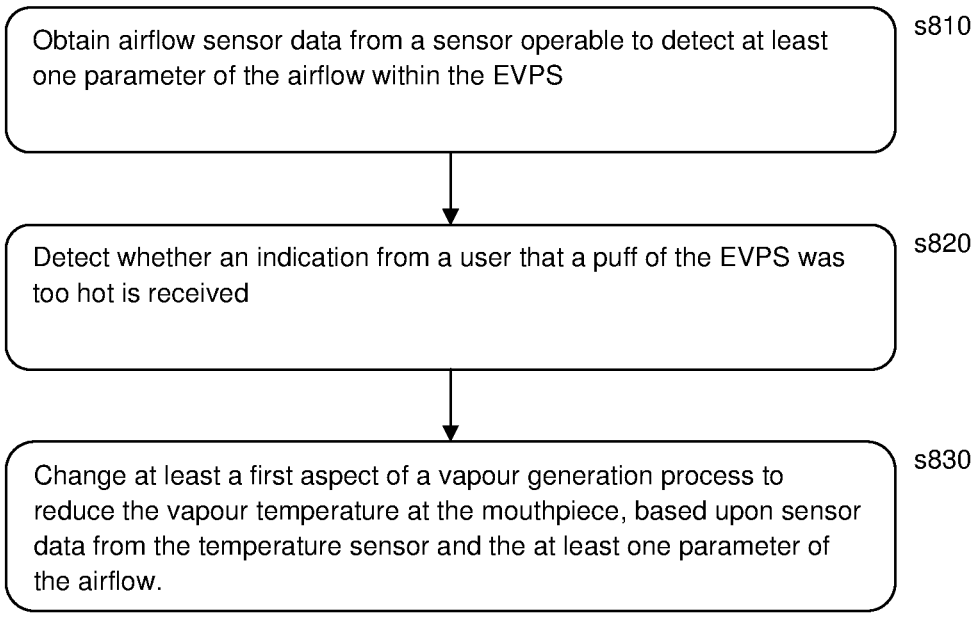
FIG. 8 is a flow diagram of a method of regulating temperature for an electronic vapor provision system in accordance with embodiments of the present invention.

Referring ow also to FIG. 8, a method of regulating temperature for an electronic vapor provision system (EVPS) comprises:

In a first step s810, obtaining airflow sensor data from a sensor operable to detect at least one parameter of the airflow within the EVPS, as described previously herein;

In a second step s820, detecting whether an indication from a user that a puff of the EVPS was too hot is received, as described previously herein; and if so In a third step s830, changing at least a first aspect of a vapor generation process to reduce the vapor temperature at the mouthpiece, based upon sensor data from the at least one parameter of the airflow, as described previously herein.

It will be apparent to a person skilled in the art that variations in the above method corresponding to operation of the various embodiments of the apparatus as described and claimed herein are considered within the scope of the present invention, including but not limited to:

- detecting whether a difference in the at least one parameter of the airflow deviates from an expected value by a predetermined amount, and if so, changing at least a first aspect of the vapor generation process responsive to the least one parameter of the airflow;
- the at least one parameter of the airflow comprises air flow rate, and if this is below an expected value by a predetermined amount, the method comprises the step of changing one or more selected from the list consisting of an effective heating temperature of a heater of the EVPS, and an effective air intake of the EVPS;
- the at least one parameter of the airflow comprises one or more selected from the list consisting of dynamic air pressure, humidity, and ambient air temperature prior to heating, and the or each parameter is above an expected value by a respective predetermined amount, the method comprises the step of changing one or more selected from the list consisting of an effective heating temperature of a heater of the EVPS, and an effective air intake of the EVPS;
- the step of changing an aspect of the vapor generation process comprises reducing the effective heating temperature of the heater of the EVPS by one or more selected from the list consisting of reducing the heater temperature, changing a duty cycle of the heater, and reducing a pre-heat temperature of the heater;
- if the effective heating temperature of the heater would need to be reduced to a temperature below the vaporization temperature of a payload of the VPS, notifying the user;
- detecting the instantaneous airflow rate, and making instantaneous changes to the effective heating temperature of the heater of the VPS in response to the instantaneous airflow rate;
- modelling an inhalation profile of the user based upon instantaneous airflow rate during inhalation, the inhalation profile being indicative of airflow rate during the course of an inhalation action by the user, and changing at least a first aspect of the vapor generation process responsive to the inhalation profile; and
- the steps of obtaining temperature sensor data and airflow sensor data occurring within the EVPS, and comprising the step of transmitting the temperature sensor data airflow sensor data to a remote processor adapted to calculate the change to at least the first aspect of the vapor generation process.

It will be appreciated that the above methods may be carried out on conventional hardware suitably adapted as applicable by software instruction or by the inclusion or substitution of dedicated hardware.

Thus the required adaptation to existing parts of a conventional equivalent device may be implemented in the form of a computer program product comprising processor implementable instructions stored on a non-transitory machine-readable medium such as a floppy disk, optical disk, hard disk, PROM, RAM, flash memory or any combination of these or other storage media, or realized in hardware as an ASIC (application specific integrated circuit) or an FPGA (field programmable gate array) or other configurable circuit suitable to use in adapting the conventional equivalent device. Separately, such a computer program may be transmitted via data signals on a network such as an Ethernet, a wireless network, the Internet, or any combination of these or other networks.

The invention claimed is:

1. A temperature regulating system of an electronic vapor provision system (EVPS), comprising:

a sensor to detect at least one parameter of an airflow within the EVPS;

a user interface adapted to receive an indication from a user that a puff of the EVPS was too hot;

in response to a received indication, a processor is adapted to detect whether a difference in the at least one parameter of the airflow deviates from an expected value by a predetermined amount, and if so, the processor is adapted to change at least a first aspect of a vapor generation process to reduce a vapor temperature at a mouthpiece, based upon sensor data from responsive to the at least one parameter of the airflow, in response to the received indication.

2. The temperature regulating system of an EVPS according to claim 1, wherein:

the at least one parameter of the airflow is air flow rate, and when the air flow rate is below an expected value by a predetermined amount, the processor is adapted to change one or more selected from the list consisting of:

i. an effective heating temperature of a heater of the EVPS; and ii. an effective air intake of the EVPS.

3. The temperature regulating system of an EVPS according to claim 1, wherein:

the at least one parameter of the airflow is dynamic air pressure, and when the dynamic air pressure is above an expected value by a predetermined amount, the processor is adapted to change one or more selected from the list consisting of:

i. an effective heating temperature of a heater of the EVPS; and ii. an effective air intake of the EVPS.

4. The temperature regulating system of an EVPS according to claim 1, wherein:

the at least one parameter of the airflow is humidity, and when the humidity is above an expected value by a predetermined amount, the processor is adapted to change one or more selected from the list consisting of:

i. an effective heating temperature of a heater of the EVPS; and ii. an effective air intake of the EVPS.

5. The temperature regulating system of an EVPS according to claim 2, wherein:

the at least one parameter of the airflow is ambient air temperature prior to heating, and when the ambient air temperature prior to heating is above an expected value by a predetermined amount, the processor is adapted to change one or more selected from the list consisting of:

i. an effective heating temperature of a heater of the EVPS; and ii. an effective air intake of the EVPS.

6. The temperature regulating system of an EVPS according to claim 1, wherein:

the at least one parameter of the airflow is static air pressure, and when the static air pressure is below an expected value by a predetermined amount, the processor is adapted to change one or more selected from the list consisting of:

iii. an effective heating temperature of a heater of the EVPS; and iv. an effective air intake of the EVPS.

7. The temperature regulating system of an EVPS according to claim 3, wherein:

the processor is adapted to reduce the effective heating temperature of the heater of the EVPS by a predetermined amount, the resulting effective heating temperature of the heater remaining above the vaporization temperature of a payload of the EVPS.

8. The temperature regulating system of an EVPS according to claim 2, wherein:

the processor is adapted to reduce the effective heating temperature of the heater of the EVPS by one or more selected from the list consisting of:

i. reducing the heater temperature;

ii. changing a duty cycle of the heater; and iii. reducing a pre-heat temperature of the heater.

9. The temperature regulating system of an EVPS according to claim 8, wherein:

the processor is adapted to reduce the effective heating temperature of the heater by an amount responsive to the difference between the detected and expected amount of the at least one parameter of the airflow.

10. The temperature regulating system of an EVPS according to claim 1, comprising:

a sensor to detect instantaneous airflow rates; and wherein the processor is adapted to make instantaneous changes the effective heating temperature of the heater of the EVPS in response to the sensor data.

11. The temperature regulating system of an EVPS according to claim 1, wherein:

the processor is adapted to model an inhalation profile of the user based upon instantaneous airflow rates detected by a sensor during inhalation, the inhalation profile being indicative of airflow rate during the course of an inhalation action by the user; and the processor is adapted to change at least a first aspect of the vapor generation process responsive to the inhalation profile.

12. The temperature regulating system of an EVPS according to claim 1, wherein:

when the processor calculates a change for an effective temperature for the heater that would be below a vaporization temperature of a payload of the EVPS, the system notifies the user.

13. The temperature regulating system of an EVPS according to claim 1, wherein:

the EVPS comprises a wireless communication unit operable to communicate with a remote device; and the processor is located in the remote device.

14. A method of regulating temperature of an electronic vapor provision system (EVPS), comprising the steps of:

obtaining airflow sensor data from a sensor operable to detect at least one parameter of an airflow within the EVPS;

detecting whether an indication from a user that a puff of the EVPS was too hot is received;

in response to a received indication, detecting whether a difference in the at least one parameter of the airflow deviates from an expected value by a predetermined amount, and if so, changing at least a first aspect of a vapor generation process to reduce a vapor temperature at a mouthpiece, based upon sensor data from responsive to the at least one parameter of the airflow.

15. The method of claim 14, wherein:

the at least one parameter of the airflow comprises air flow rate; and when the air flow rate is below an expected value by a predetermined amount, the method comprises the step of changing one or more selected from the list consisting of:

i. an effective heating temperature of a heater of the EVPS; and ii. an effective air intake of the EVPS.

16. The method of claim 14, wherein:

the at least one parameter of the airflow comprises one or more selected from the list consisting of:

i. dynamic air pressure;

ii. humidity; and iii. ambient air temperature prior to heating, and the or each parameter is above an expected value by a respective predetermined amount, the method comprises the step of changing one or more selected from the list consisting of:

i. an effective heating temperature of a heater of the EVPS; and ii. an effective air intake of the EVPS.

17. The method of claim 14, wherein the step of changing an aspect of the vapor generation process comprises reducing the effective heating temperature of the heater of the EVPS by one or more selected from the list consisting of:

i. reducing the heater temperature;

ii. changing a duty cycle of the heater; and iii. reducing a pre-heat temperature of the heater.

18. The method of claim 17, further comprising notifying the user when the effective heating temperature of the heater would need to be reduced to a temperature below the vaporization temperature of a payload of the EVPS in response to changing an aspect of the vapor generation process.

19. The method of claim 14, comprising the steps of:

detecting the instantaneous airflow rate; and making instantaneous changes to the effective heating temperature of the heater of the VPS in response to the instantaneous airflow rate.

20. The method of claim 14, comprising the steps of:

modelling an inhalation profile of the user based upon instantaneous airflow rate during inhalation, the inhalation profile being indicative of airflow rate during the course of an inhalation action by the user; and changing at least a first aspect of the vapor generation process responsive to the inhalation profile.

21. The method of claim 14, wherein the steps of obtaining temperature sensor data and airflow sensor data occur within the EVPS, and comprising the step of:

transmitting the temperature sensor data airflow sensor data to a remote processor adapted to calculate the change to at least the first aspect of the vapor generation process.

22. A non-transitory computer readable medium having computer executable instructions adapted to cause a computer system to perform the method of claim 14.

* * * * *